US008033040B2

(12) United States Patent
Flynn

(10) Patent No.: US 8,033,040 B2
(45) Date of Patent: Oct. 11, 2011

(54) CUSTOMIZABLE GIFT BOX

(75) Inventor: Timothy J. Flynn, Key Largo, FL (US)

(73) Assignee: Continental Datalabel, Inc., Elgin, IL (US)

( * ) Notice: Subject to any disclaimer, the term of this patent is extended or adjusted under 35 U.S.C. 154(b) by 532 days.

(21) Appl. No.: 11/585,653

(22) Filed: Oct. 24, 2006

(65) Prior Publication Data

US 2008/0141568 A1 Jun. 19, 2008

(51) Int. Cl.

| | |
|---|---|
| ***G09F 3/00*** | (2006.01) |
| ***G09F 3/10*** | (2006.01) |
| ***B65D 65/38*** | (2006.01) |
| ***B65D 25/34*** | (2006.01) |
| ***B65D 85/575*** | (2006.01) |

(52) U.S. Cl. ..... 40/312; 40/638; 229/87.18; 229/87.19; 229/116.5; 229/923; 206/387.1

(58) Field of Classification Search ..... 40/312, 40/638; 229/87.18, 87.19, 116.5, 923; 206/387.1
See application file for complete search history.

(56) References Cited

U.S. PATENT DOCUMENTS

| | | | | |
|---|---|---|---|---|
| 5,103,978 | A * | 4/1992 | Secor | 206/387.1 |
| 5,186,566 | A * | 2/1993 | Cameron | 402/79 |
| 5,337,943 | A * | 8/1994 | Hendren | 229/87.19 |
| 2008/0093427 | A1 | 4/2008 | Kuranda | |

FOREIGN PATENT DOCUMENTS

| | | | |
|---|---|---|---|
| JP | 2002-23636 | A | 1/2002 |
| JP | 2002-225071 | A | 8/2002 |
| JP | 2005-173300 | A | 6/2005 |
| WO | WO 92/16436 | | 10/1992 |

OTHER PUBLICATIONS

Co-pending U.S. Appl. No. 12/496,381, "Customizable Gift Box," filed Jul. 1, 2009.
Co-pending U.S. Appl. No. 12/496,410, "Method of Making Customizable Gift Box," filed Jul. 1, 2009.

* cited by examiner

*Primary Examiner* — Joanne Silbermann
*Assistant Examiner* — Syed A Islam
(74) *Attorney, Agent, or Firm* — Pauley Petersen & Erickson

(57) ABSTRACT

A customizable gift box includes a box blank and a label assembly. The label assembly preferably includes a face sheet having a printable surface including a label sized to cover the box blank and a back sheet having a removable portion at least partially overlaying the label, the removable portion removable to expose an adhesive surface of the label within the face sheet. In addition, at least one index line is positioned on the label assembly for aligning the box blank relative to the label.

20 Claims, 3 Drawing Sheets

CUSTOMIZABLE GIFT BOX

BACKGROUND OF THE INVENTION

1. Field of the Invention

This invention is directed to a customizable gift box that includes a box blank and a label assembly with a label having a printable surface.

2. Description of Related Art

Gift boxing and wrapping is necessary component of gift giving. Often, gift givers need dedicated space for wrapping paper of all varieties and boxes of various sizes and shapes to accommodate such gifts. Gift bags are one accommodation to the space requirements of traditional gift boxes and wrapping. However, like wrapping paper, gift bags are generally thematic and not all gift bags are appropriate for all gift giving situations.

As such, a need arises for a customizable gift box that a gift giver may design that is appropriate for the particular gift, event, occasion, season and/or recipient. Such customizable gift boxes eliminate the need for a gift giver to stock and/or independently purchase a tailor-made gift wrap or gift box for each particular gift, event, occasion, season and/or recipient.

SUMMARY OF THE INVENTION

It is an object of the present invention to provide a customizable gift box.

The above and other objects of this invention can be attained with a box blank and label assembly including a back sheet and a face sheet removably adhered to the back sheet.

The face sheet has a carrier portion and at least one label. An opposite back sheet is affixed to the face sheet. The face sheet preferably includes an adhesive material coating on one side facing the back sheet and a printable surface on an opposite side. The label assembly is preferably manufactured of a size and material to permit feeding into any number of standard printers, such as a consumer laser printer.

In operation, the label assembly preferably includes the face sheet having a printable surface including a label sized to cover at least a box bottom of the box blank. The label assembly is preferably customized by printing the label with a standard printer to include desired designs, writing, etc. appropriate to the situation.

The back sheet preferably includes a first removable portion at least partially overlaying the label. The first removable portion is preferably separable from the label assembly and removable to expose an adhesive surface of the label within the face sheet. The back sheet preferably further includes at least one index line for aligning the box blank relative to the label assembly, specifically relative to the label.

Thus, following removal of the first removable portion thereby exposing a partial surface of the label, at least one edge of the box blank can be aligned with one or more index lines without adhering the label to the box blank. Once aligned, the box blank can be adhered to the exposed section of the label and the remainder of the label can be applied to the box blank.

As a result of the label assembly as described, removal of one or more removable portions from the back sheet results in the label remaining in a carrier portion of the face sheet, preferably with the adhesive side facing upward. This configuration facilitates alignment and placement of the box blank without curling or unwanted adhesion that may result from peeling the label away from the back sheet.

Other objects and advantages of this invention are apparent to those skilled in the art, in view of the following detailed description taken in conjunction with the appended claims and drawings.

BRIEF DESCRIPTION OF THE DRAWINGS

The present invention can be better understood with reference to the following drawings. In the drawings, like reference numerals designate corresponding parts throughout the several views. The drawings are not necessarily to scale and emphasis is placed upon clearly illustrating principles of the present invention.

DETAILED DESCRIPTION OF PREFERRED EMBODIMENTS

Figure 1:
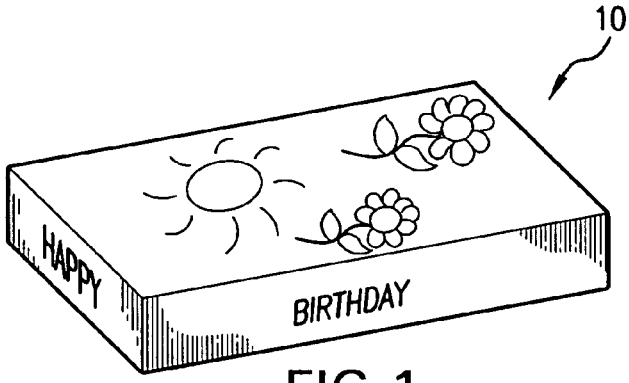
FIG. 1 is a perspective view of a gift box according to a preferred embodiment of this invention.
Figure 2:
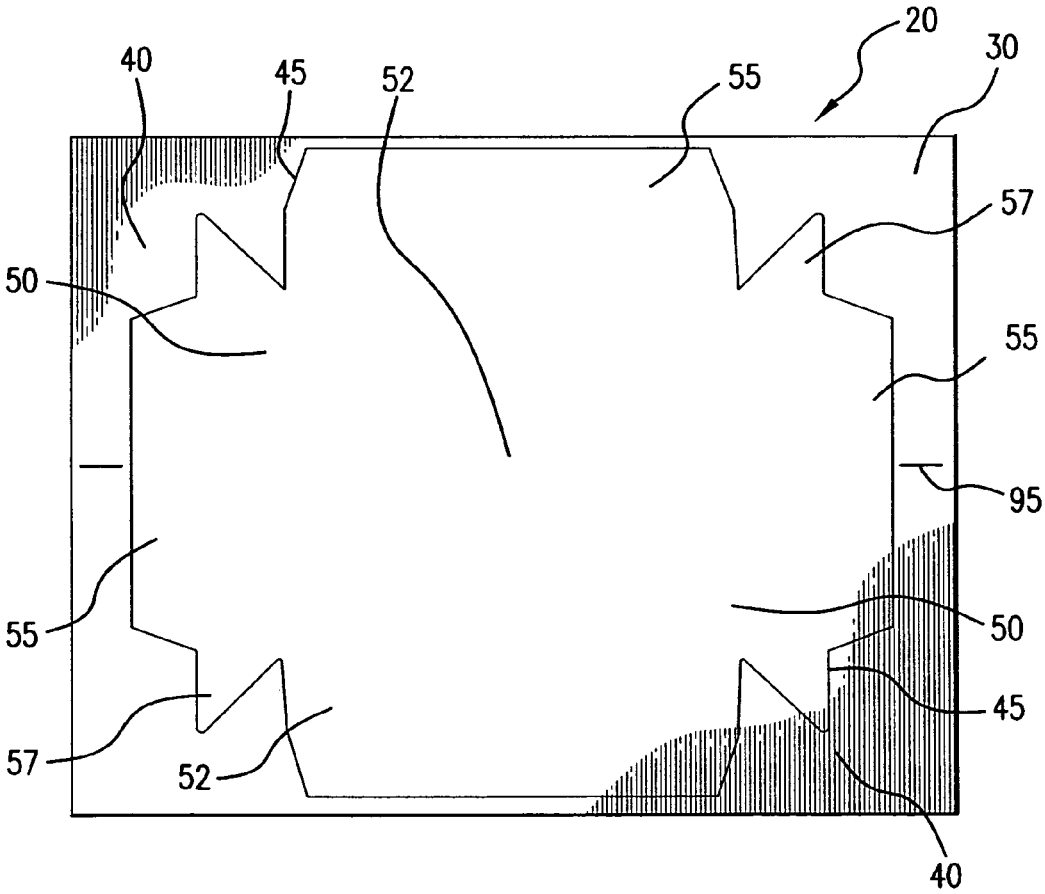
FIG. 2 is a plan view of a face sheet side of a label assembly according to one preferred embodiment of this invention.
Figure 3:
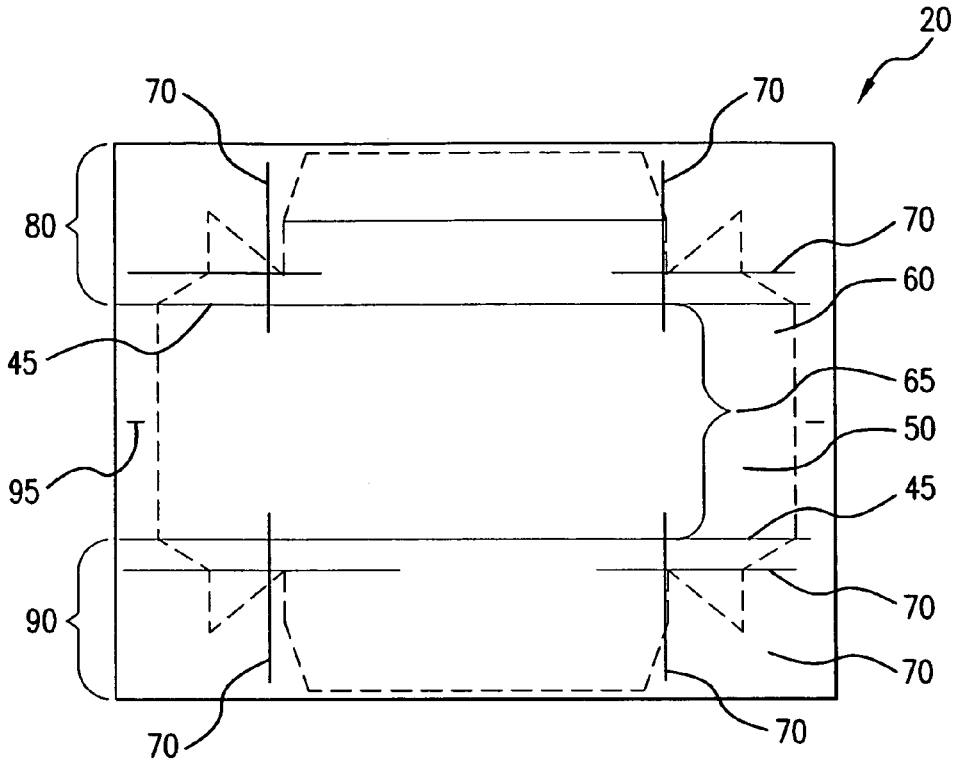
FIG. 3 is a plan view of a back sheet side of a label assembly opposite a face sheet side shown in FIG. 2, according to one preferred embodiment of this invention.

The present invention is directed to a customizable gift box 10, such as shown FIG. 1, including box blank 15 and label assembly 20, such as shown in FIGS. 2 and 3. Gift box 10 preferably includes box blank 15 and label assembly 20. At least a portion of label assembly 20 is preferably printable or otherwise customizable and then assembled with box blank 15 to result in a lid and/or base of the gift box 10.

Figure 4:
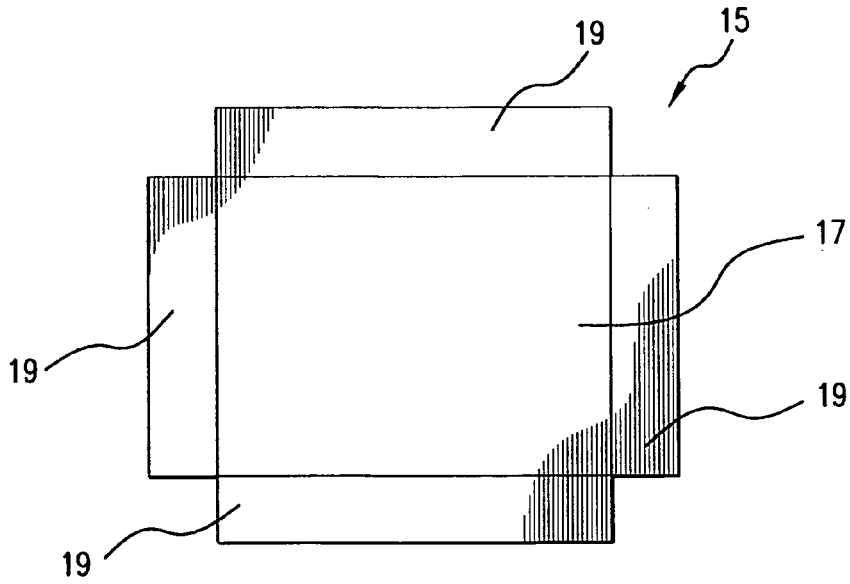
FIG. 4 is a plan view of a box blank according to one preferred embodiment of this invention.

According to a preferred embodiment of this invention, box blank 15 such as shown in FIG. 4, includes box bottom 17 and at least two sidewalls 19. Box blank 15 may be constructed of cardboard, paper, card stock or other suitable material having similar and/or desirable properties for supporting gift box 10. As shown, sidewalls 19 are preferably foldable relative to box bottom 17 so as to form a general shape of gift box 10. As used herein, "gift box" may include a top, a bottom or entire box construction suitable for containing a gift or other object. It is contemplated that the "gift box" may include additional applications aside from gifts, such as business uses, postal uses or any other suitable use that requires a customizable box.

Label assembly 20 preferably includes a face sheet 30 and back sheet 60 removably adhered to face sheet 30. Face sheet 30 preferably includes carrier portion 40 and at least one label 50 that is removable from the back sheet 60 and separable from carrier portion 40. Label 50 preferably includes at least one printable surface 52 upon which information, decorations, personalization, etc. can be printed to customize gift box 10 formed from box blank 15 and label assembly 20.

FIGS. 2 and 3 show each side of a label assembly 20 (not necessarily shown to scale) according to one embodiment of this invention. Label sheet 20 is desirably formed of a face sheet 30, shown in FIG. 2, and an opposite back sheet 60, shown in FIG. 3. Back sheet 60 is desirably approximately the same size as face sheet 30, but may be slightly larger or smaller than face sheet 30. A surface of face sheet 30 that is disposed toward back sheet 30 preferably includes an adhesive material coating. The adhesive coating can include any adhesive material known and available to those skilled in the art for forming pressure sensitive, or self-adhesive labels.

Label assembly 20 is preferably of any suitable shape, and generally any suitable size that can be accepted by and fed through a printer, such as a laser printer or an ink jet printer. Common sizes of paper generally fed through printers are 8.5 inches by 5.5 inches, 8.5 inches by 11 inches, 8.263 inches by 11.688 inches (A4 size), and 8.5 inches by 14 inches. Face sheet 30 is preferably, but not necessarily, constructed of any suitable paper, paper composite, non-metal and/or metal material that can be used as a label. Other suitable materials for constructing face sheet 30 include fabric, plastic, and metal foils. The adhesive coating covered by back sheet 60 is preferably applied to face sheet 30 in any suitable manner known to those skilled in the art. Face sheet 30 desirably has a printable surface 52 on a side opposite the adhesive coating.

Face sheet 30 and printable surface 52 can be any of a variety of face materials used to make pressure sensitive, or self-adhesive labels. Such face materials may include, but are not limited to: smudgeproof stock, litho stock, cast coated stock, tag stock, fluorescent stock, foils, computer printable polyester, vinyl, satin cloth, Tyvek™ material, flexible plastic, book papers, photo quality papers and/or photo quality film. Furthermore, various portions of the face materials can be different colors, thereby resulting in different colored parts.

The phrase "printable surface" relates to a surface of any type of matter upon which a person or machine can draw, print, color, paint, photocopy, write, emboss, or make any other type of mark or graphic. Laser printers, ink jet printers, impact printers, thermal transfer printers, direct thermal printers, typewriters, or any other suitable graphic printing devices are preferred but not necessary for use with printable surfaces according to this invention. Customization on label 50 may include one or more images, patterns, print, pictures, drawings, letters, numbers, words and/or symbols, for example, to relate the gift giver, receiver and/or contents of the gift box 10 to the customization.

As briefly described above, a layer of an adhesive is preferably positioned between back sheet 60 and face sheet 30 so that the adhesive adheres to face sheet 30 exclusively or at least adheres to face sheet 30 more than to back sheet 60 when back sheet 60 is removed from face sheet 30, as described hereafter. As a result of this configuration, label assembly 20 preferably includes face sheet 30 having a printable side and an opposite, adhesive side and back sheet 60 including a separable side and an opposite side.

Face sheet 30 may include a plurality of shapes of labels 50, defined in face sheet 30 as one or more individual labels 50 according to this invention. The phrase label 50, "shape," or the phrase "removable or tearable shape," are intended to relate to a shape, such as the shapes identified in FIG. 2 by element reference numeral 50, that can be removed or torn away from a remaining carrier portion 40 of face sheet 30, such as by using tearable lines of separation 45. Specifically; as described below in more detail, label 50 is preferably dimensioned to cooperate with a particular box blank 15 depending on the size and shape of the gift box 10 desired.

Tearable lines of separation 45 can be formed as a line of weakness and/or cut in face sheet 30 known to those skilled in the art, such as die-cut lines, perforated lines, micro-perforated lines, or any combination of these types of separation, or any other suitable structure that enables separation. A preferred type of tearable line 45 is a line that is die-cut. Label 50 can be die-cut along at least a portion of a periphery, such that label 50 can be easily removed or separated from carrier portion 40 of face sheet 30, for example after label assembly 20 is run through a printer and removable portions 65, 80 and/or 90 of back sheet 60 are removed as described below.

In operation, label assembly 20 preferably includes face sheet 30 having printable surface 52 on label 50 that is sized to cover at least box bottom 17 of box blank 15. As described above, label assembly 20 is preferably customized by printing label 50 with a standard printer to include desired designs, writing, etc.

As shown in FIG. 3, back sheet 60 preferably includes first removable portion 65 at least partially overlaying label 50 (shown in hidden lines). First removable portion 65 is preferably separable from label assembly 20 and removable to expose an adhesive surface of label 50 within face sheet 30. First removable portion 65 is preferably exclusive to back sheet 60 and is removable along at least two tearable lines of separation 45 extending through the back sheet 60, but not into face sheet 30.

As shown in FIG. 3, back sheet preferably further includes at least one index line 70 for aligning box blank 15 relative to label assembly 20, specifically relative to label 50. Accordingly, following removal of first removable portion 65 thereby exposing a partial surface of label 50, at least one edge of box blank 15 can be aligned with one or more index lines 70 without adhering label to box blank 15. Once aligned, box blank 15 can be adhered to the exposed section of label 15.

According to a preferred embodiment of this invention, not all of label 50 will be exposed following removal of first removable portion 65. As a result, second and/or third removable portions 80, 90 may also be removable from back sheet 80 to more fully expose label 50. The second and/or third removable portions 80, 90 preferably at least partially overlay label 50 and are removable to expose additional adhesive surface of label 50.

According to a preferred embodiment of the invention, and to facilitate proper and accurate alignment of box blank 15 relative to label 50, first removable portion 65 preferably includes a width smaller than a width of box bottom 17. As a result of the small width of first removable portion 65, box blank 15 can be aligned with label 50 along index lines 70 without unintentionally adhering portions of box bottom 17 to label 50. However, as described in more detail below, label 50 preferably includes a width wider than a width of box bottom 17.

Figure 5:
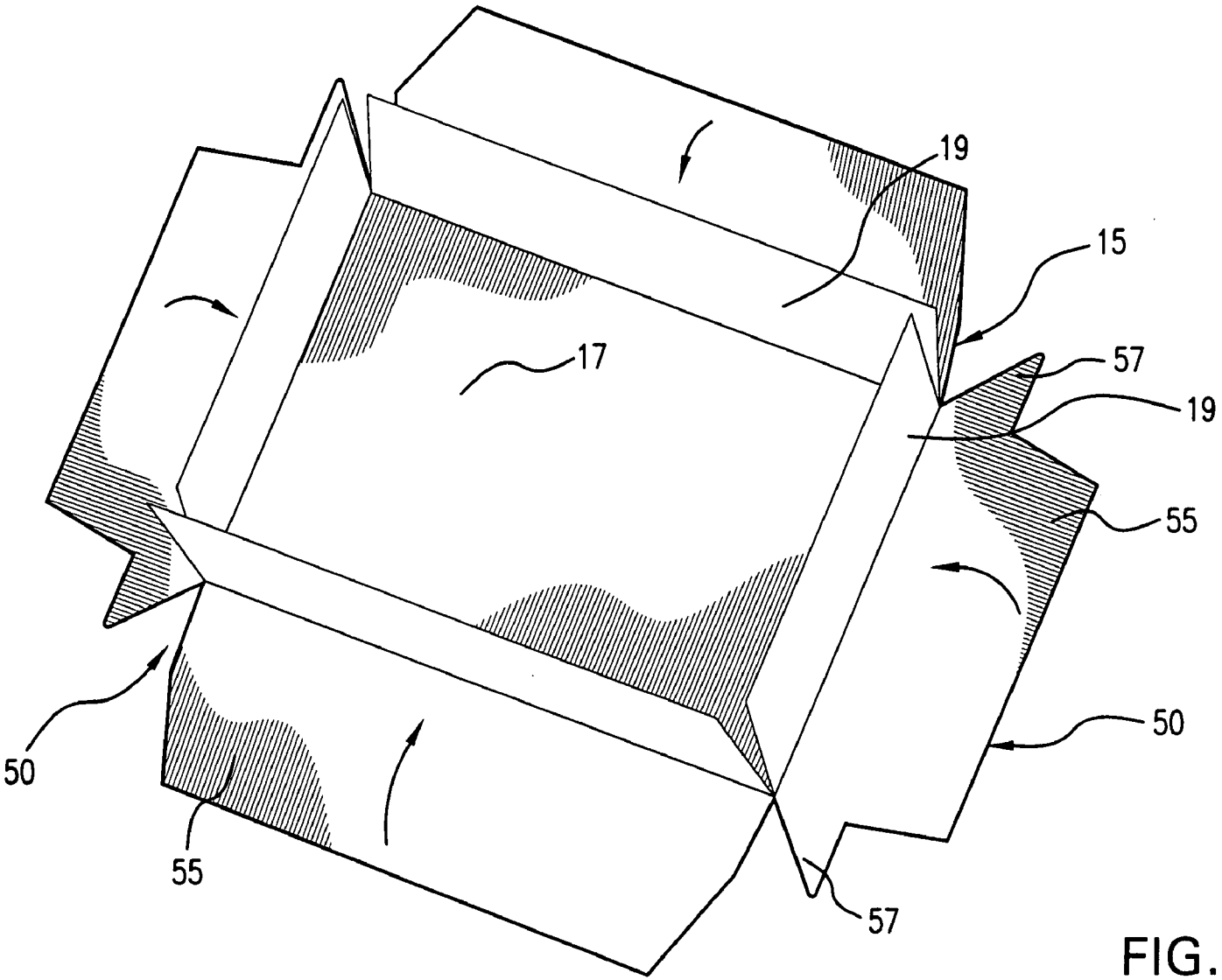
FIG. 5 is a perspective view of a box blank and label assembly following partial adhesion of a label according to a preferred embodiment of this invention.

Following removal of first, second and/or third removable portions 65, 80, 90 of label assembly 20, label assembly 20 is preferably positioned underneath box blank 15 with a portion of label 50 adhesively fixed to box blank 15. As shown in FIG. 5, additional portions of label 50 preferably extend beyond box bottom 17 of box blank 15 in the form of tabs 55 thereby permitting sidewalls 19 of box blank to be entirely covered by label 50. In addition, one or more extended portions 57 of tabs 55 preferably extend outwardly from tabs 55 to permit adjoining of adjacent sidewalls 19 of box blank 15 to form gift box 10.

As shown in FIGS. 3 and 5, first removable portion 65 is preferably positioned along a center of label 50. As such, upon removal of first removable portion 65 from label assembly 20, box blank 15 is preferably indexable relative to each side of label 50 along remaining portions of back sheet 60.

In this manner, index lines 70 are preferably positioned outside of first removable portion 65 so that a visual index can be drawn between box blank 15 and label assembly 20. More specifically, two index lines 70 are preferably positioned one on either side of first removable portion 65. Index lines 70 are preferably inked or otherwise marked into back sheet 60 so as to be readily legible and apparent to a user. In addition, index lines 70 are preferably positioned along second removable portion 80 and/or third removable portion 90 of back sheet 60 and not in an adhesive section of label 50. In this manner, box blank 15 may be aligned and adjusted without adhering label 50 to box bottom 17 or sidewalls 19.

In addition, second removable portion 80 and third removable portion 90 are preferably positioned along outer edges of label 50 so that, following indexing and adherence of center portion of label 50 to box bottom 17, the remaining portions of label 50 may be properly adhered to box blank 15 as described.

As a result of label assembly 20 as described, removal of first, second, third and/or additional removable portions 65, 80, 90 from back sheet 60, label 50 remains in carrier portion 40 of face sheet 30, preferably with the adhesive side facing upward. This configuration facilitates alignment and placement of box blank 15 without curling or unwanted adhesion that may result from peeling label 50 away from back sheet 60. Following proper, aligned adhesion of label 50 to box blank, label 50 is removed from remainder of carrier portion 40 on face sheet 30 along tearable lines of separation 45, as previously described.

One or more score lines 95 may be positioned in back sheet 60 and/or face sheet 30 and preferably extend from at least one edge of first removable portion 65. Such score lines 95, unlike tearable lines of separation 45, preferably extend entirely through label assembly 20 and facilitate removal of first removable section 65 as well as separation of carrier portion 40 from label 50 during or following application of label 50 to box blank 15.

In decorating label 50 according to one preferred embodiment of this invention, label assembly 20 is routed through a suitable printer. Information downloaded from an internet website or saved on a computer database for example, is printed on at least one printable surface 52 of face sheet 30. For example, in one preferred embodiment of this invention, a first set of information, such as an image of the gift recipient, is printed on printable surface 52 of label 50. In one preferred embodiment of this invention, a database containing or having a plurality of downloadable images is accessible from a personal computer or work station. At least one of the downloadable images can be selected to download. After the image is downloaded, the image is printed on label 50. As used in the specification and in the claims, the term "information" refers to any suitable or desirable electronic image or design, such as a digital photograph, picture, drawing, pattern, text and/or symbol.

While in the foregoing specification this invention has been described in relation to certain preferred embodiments thereof, and many details have been set forth for purpose of illustration, it will become apparent to those skilled in the art that the invention is susceptible to additional embodiments and that certain of the details described herein can be varied considerably without departing from the basic principles of the invention. Therefore, to particularly point out and distinctly claim the subject matter regarded as the invention, the following claims conclude the specification.

I claim:

1. A customizable gift box comprising:

a box blank comprising a box bottom and at least two sidewalls; and a label assembly, the label assembly including a face sheet having a printable surface including a label sized to cover the box blank;

a back sheet of approximately a same size as the face sheet, the back sheet having a removable portion at least partially overlaying the label, the removable portion removable to expose an adhesive surface of the label within the face sheet; and two index lines inked or marked on the adhesive surface or on a surface of the back sheet for aligning the box blank relative to the label, a first of the index lines extending across a second of the two index lines.

2. The customizable gift box of claim 1 further comprising:

a second removable portion of the back sheet, the second removable portion at least partially overlaying the label and removable to expose additional adhesive surface of the label, wherein the two index lines are inked or marked on the second removable portion.

3. The customizable gift box of claim 1 wherein the removable portion includes a width smaller than a width of the box bottom and the label includes a width wider than a width of the box bottom.

4. The customizable gift box of claim 2 further comprising:

a third removable portion of the back sheet, the third removable portion at least partially overlaying the label and removable to expose additional adhesive surface of the label; and a further pair of index lines marked on the third removable portion, wherein a first of the further pair of index lines extends across a second of the further pair of index lines.

5. The customizable gift box of claim 4 wherein the first removable portion is positioned along a center of the label and the second removable portion and the third removable portion are positioned along outer edges of the label.

6. The customizable gift box of claim 1 wherein the two index lines are positioned outside of the first removable portion.

7. The customizable gift box of claim 6 further comprising an additional two index lines positioned on an opposite side of the first removable portion from the two index lines.

8. The customizable gift box of claim 1 wherein the label assembly is dimensioned to pass through a printer.

9. The customizable gift box of claim 1 wherein the removable portion includes a width smaller than a width of the box bottom.

10. A customizable gift box comprising:

a box blank comprising a box bottom and two sidewalls; and a label assembly, the label assembly including a face sheet having an adhesive label sized to at least partially cover the box blank, the label including a portion sized to cover the box bottom, a first tab extending from the portion and sized to cover a first of the sidewalls, and a second tab extending from the portion and sized to cover a second of the sidewalls, the first tab including an extended edge extending beyond a width of the first of the two sidewalls for adhering to the adjacent second of the two sidewalls and securing the two side walls in an upright position;

a back sheet of approximately a same size as the face sheet, the back sheet having a first removable portion and a second removable portion, distinct from the first removable portion, the first removable portion and the second removable portion each at least partially overlaying the label;

a tearable line of separation extending through the back sheet and defining an edge of the first removable portion and an edge of the second removable portion. and two index lines inked or marked on the back sheet for aligning the box blank relative to the label, a first of the index lines extending across a second of the index lines at an intersection on the second removable portion and positioned along and spaced apart from the first removable portion.

11. The customizable gift box of claim 10 wherein the label further comprises:

an extended edge positioned on at least one side of each tab.

12. The customizable gift box of claim 10 wherein the first removable portion includes a width smaller than a width of the box bottom and the label includes an overall width wider than a width of the box bottom.

13. The customizable gift box of claim 12 wherein the label includes an overall width wider than a width of the box blank.

14. The customizable gift box of claim 10 further comprising a score line positioned in the back sheet extending from at least one edge of the first removable portion.

15. A label assembly comprising:

a face sheet having a carrier portion and a label;

at least one line of separation formed between the at least one label and the carrier portion to define an outer periphery of the label, the label removable with respect to the carrier portion;

a back sheet of approximately a same size as the face sheet, the back sheet having a first removable portion overlaying a first portion of the label;

a second removable portion overlaying a second portion of the label, the second removable portion removable from the face sheet to expose an adhesive surface of the label; and two pairs of index lines inked or marked on the back sheet, a first of the two pairs spaced apart from a second of the two pairs, and each of the two pairs including a first index line extending across a second index line.

16. The label assembly of claim 15 wherein the label is printable and sized to adhere to a box blank.

17. The label assembly of claim 16 wherein the first removable portion is narrower than the box blank.

18. The label assembly of claim 17 wherein the second removable portion is wider than the box blank.

19. The label assembly of claim 15 wherein the first of the two pairs of index lines is on an opposite side of the first removable portion from the second of the two pairs of index lines.

20. The customizable gift box of claim 10 further comprising two index lines inked or marked on a surface of the second removable portion for aligning the box blank relative to the label, a first of the index lines extending across a second of the two index lines.

* * * * *